US005582446A

United States Patent [19]

Walker, Jr.

[11] Patent Number: 5,582,446

[45] Date of Patent: Dec. 10, 1996

[54] DOOR STABILIZER CLIP

[75] Inventor: James T. Walker, Jr., Livonia, Mich.

[73] Assignee: Exotic Rubber & Plastics Corporation, Farmington, Mich.

[21] Appl. No.: 507,725

[22] Filed: Jul. 26, 1995

[51] Int. Cl.[6] ..... E05C 19/18

[52] U.S. Cl. ..... 292/288; 292/339

[58] Field of Search ..... 292/288, 339, 292/DIG. 19

[56] References Cited

U.S. PATENT DOCUMENTS

| | | | |
|---|---|---|---|
| 2,974,989 | 2/1961 | Hilbers | 292/339 X |
| 3,180,668 | 4/1965 | Brown | 292/288 X |
| 3,620,483 | 11/1971 | Weinberger | 292/288 X |
| 4,124,240 | 11/1978 | Adelberg | 292/339 |

FOREIGN PATENT DOCUMENTS

| | | | |
|---|---|---|---|
| 421500 | 11/1925 | Germany | 292/288 |

*Primary Examiner*—Rodney M. Lindsey
*Attorney, Agent, or Firm*—Young & Basile, P.C.

[57] ABSTRACT

A door stabilizer clip for use to hold a vehicle door in a spaced relationship from the vehicle body frame comprising a clamp body and a locking lever pivotally connected by a pivot pin. The clamp body has a C-shaped configuration with a cantilever extending thereof. The cantilever extension provides for opposing lips to define a channel for securing a door window frame and the C-shaped body defines a cavity for securing a vehicle frame. The opposing lips maintain the door window frame and the vehicle frame in a predetermined space relationship. The locker lever rotates about the pivot pin and C-shaped body to selectively lock and release the door stabilizer clip with respect to the vehicle frame.

9 Claims, 2 Drawing Sheets

DOOR STABILIZER CLIP

FIELD OF THE INVENTION

The present invention relates to a device for holding a vehicle door partially open and away from the door frame.

BACKGROUND OF THE INVENTION

During the manufacturing process of a vehicle and after the vehicle has been painted, care must be provided to not damage the paint finish from the time the paint is dry until the door catches are installed. During this interval of time, the vehicles may be temporarily stored in automatic racks as well as continue the assembly of many aspects of the vehicle before installation of the rubber stripping and door catches to the vehicle doors. If during this time the vehicle door comes in contact with the vehicle frame, the paint is subject to chipping and scratching. In the alternative, if the vehicle door is open too far, then the door is subject to hitting items as the vehicle passes along the assembly line process or as it is being delivered to and from the automated storage racks. Therefore, it is desired to provide a means that holds the vehicle door approximately ½ inch away from the vehicle frame.

An existing method currently used by some vehicle manufacturers is to apply sticky back foam pads to the vehicle frame at points where the door would contact the frame when closed. The doors are then closed and tape is wrapped around the door window frame and a section of the vehicle frame. When the door is ready to be opened, the tape and pads are removed and discarded. This procedure has inherent disadvantages such as the time spent removing the foam pads from a dispensing roll, installing the pads at strategic points on the vehicle frame, unwrapping the tape from a dispenser roll and then wrapping the tape around a window and vehicle frame and then later unwrapping and removing the tape and foam pads from the vehicle doors and frame. If unexpected non-routine work is necessary for a particular vehicle, the tape must be removed temporarily and then reapplied. In addition, once the tape and foam pads have been permanently removed from the frame and doors, the residual adhesive on the paint must be cleaned.

Another disadvantage of this procedure is that the foam pads and tape material are generally not reusable and are discarded after a single use. This procedure adds to waste disposal costs. In addition, there can be occasions where the door edges break through the foam causing that break-through area to require a paint retouch after the foam has been discarded.

An alternative method used by some manufacturers is to substitute a removable belt for the tape. The belt saves on the cost of tape disposal, but the belts take longer to install and remove, and the belts may not be compatible with all vehicle models. In addition, installation labor costs of the belt and foam still are present.

An object of the invention is to significantly reduce material and labor costs in the installation. It is further an object of the invention to provide a device that is easier and faster to install by the operator. It is also an object of the invention to eliminate adhesive which generally needs to be cleaned from the paint. Finally, it is an object of the invention to provide a reusable device and thereby remove or diminish disposal costs.

SUMMARY OF THE INVENTION

The present invention provides a door stabilizer clip that can be installed on a welding flange of a vehicle door frame or a vehicle roof frame. The door stabilizer clip generally has a main body having a C-shaped configuration. Opposing legs that define the C-shaped configuration form a cavity disposed between the legs for receiving a portion of the vehicle door or roof frame. A cantilever extension extends from the main body. Proximate to the end of the cantilever extension is a restraining means for securing a portion of the vehicle door. A spacer formed by one of the legs of the C-shaped main body, the C-shaped main body itself, or a stop point on the cantilever extension prevents the vehicle door from contacting the vehicle frame.

A locking lever is pivotally attached to the main body to selectively lock or release the main body from the vehicle frame. The locking lever has one end having a rounded surface that frictionally secures the vehicle frame within the cavity when the locking lever is in the lock position. When the locking lever is in the release position, the rounded surface releases the vehicle frame, so that the door stabilizer clip can be removed away from the vehicle frame.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
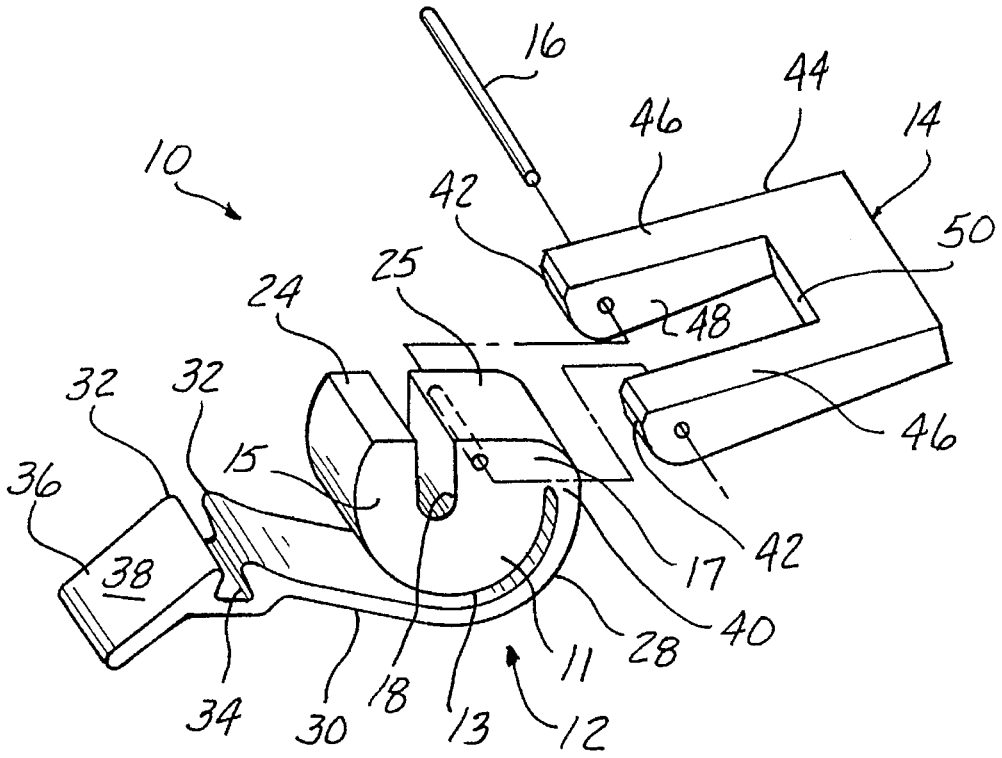
FIG. 1 is an exploded view of the preferred embodiment of the door stabilizer clip.
Figure 2:
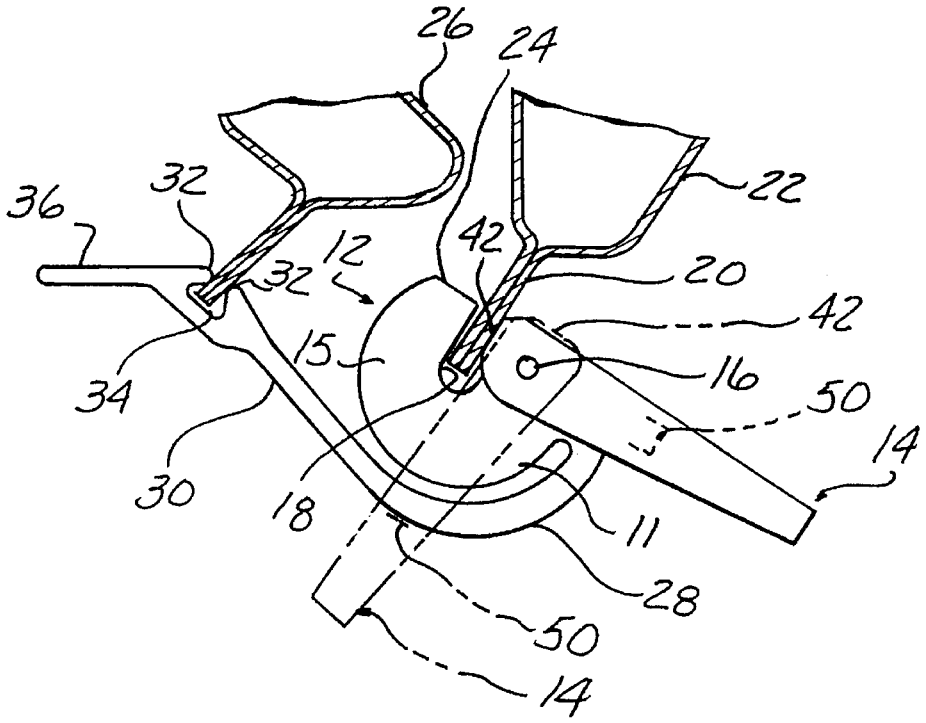
FIG. 2 is the door stabilizer clip attached to a welding flange of a vehicle side frame and a door window frame.

The door stabilizer clip 10 as shown in FIGS. 1 and 2 comprises a clamp body 12 and a locking lever 14 pivotally connected to each other by a pivot pin 16. The clamp body 12 is an essentially C-shaped body 11 having an accessible cavity 18 for receiving a welding flange 20 of a vehicle frame 22. The C-shaped body 11 is preferably made of a plastic material which may have a metal reinforcement (not shown) shaped to conform to the body and embedded therein. A lower extent 25 of the main C-shaped body 11 provides the portion about which the locking lever 14 pivots. The lower extent 25 of the C-shaped body 11 has an integral extension 28 encircling a portion of the exterior 13 of the C-shaped body 11. The integral extension 28 extends past the C-shaped body 11 into a cantilever projection 30. Approximately midway along the length of the cantilever projection 30 there are upwardly opposing lips **32*a* and 32*b* that form a channel 34 for receiving a portion of a door window frame 26 and also acts as a stop to separate the door frame 26 from the vehicle frame 22. Adjacent to lip 32*b* and extending to the end of the cantilever projection 30 is a thumb depress portion 36. Thumb depress 36 provides two functions. First, depress 36 acts as a lead-in to allow door frame 26 to slide into channel 34. The thumb depress portion 36 has an angular planar surface 38 relative to cantilever projection 30. When the vehicle door is shut the door window frame 26 slides over planar surface 38 before being caught in channel 34 between opposing lips 32***a*, 32*b*. The opposing lips 32*a*, 32*b* and channel 34 act as a stop to prevent the door from coming into contact with the vehicle frame 22. Secondly, thumb depress 36 allows an operator to position his thumb on the surface 38 and flex the cantilever projection 30 away from the door window frame 26 that is received in the channel 34. This configuration allows the door stabilizer clip 10 to be temporarily disengaged from the door window frame 26, while clip 10 is still engaged with the vehicle side frame 22. In the preferred embodiment, the cantilever projection 30 flexes all along projection 30 and extension 28 from point 40 where the integral extension 28 is joined to meet the C-shaped body 11.

The locking lever 14 includes rounded cam surfaces 42 at one end and a locking handle 44 at the distal end. The locking lever mechanism 14 has a two prong 46 configuration. The two prongs 46 terminate at the rounded outer cam surface ends 42. When the lever 14 is pivoted about the main body 11, in the position shown in solid lines in FIG. 2, the rounded cam surfaces 42 engage and frictionally lock the welding flange 20 of the vehicle frame 22 within a cavity 18 formed by legs 15 and 17 of C-shaped body 11. A rubber section 29 may be added to an interior of leg 15 or 17 forming one of the walls of cavity 18 to provide additional frictional grip to hold flange 20 within cavity 18. At a distal end is a handle portion 44 to manually lock the locking lever 14 in place. Each prong 46 includes an inner side surface 48 that is parallel and spaced from each other. The parallel inner side surfaces 48 meet at a distal end from the rounded cam surface 42 to form an inner back surface 50. The two inner side surfaces 48 are spaced from each other at a distance so that the two prongs 46 may extend over leg 17 of the C-shaped body 11; and provide enough clearance to allow the locking lever 14 to pivot about the C-shaped body 11 and the integral extension 28 of the clamp body 12. The locking lever 14 is pivotally connected to the leg 17 of the C-shaped body 11 by means of a spring loaded locking pivot pin 16. The inner back surface 50 of the locking lever 14 is spaced from the rounded cam surfaces 42 of the two prongs 46 so that there is a clearance between the outer surface of the integral extension 28 and the inner back surface 50 to allow adequate pivotal movement.

FIG. 2 shows the preferred embodiment of the door stabilizer clip engaged to a door window frame 26 within the channel 34 of the cantilever extension 30 and a welding flange 20 of a vehicle frame 22.engaged within the cavity 18 of the C-shaped clamp body 12. The locking lever 14 is shown in solid line in the locking position so that rounded cam surfaces 42 are in engagement with the welding flange 20. In phantom, the locking lever 14 is shown in a release position. When locking lever 14 is in the release position, lever 14 can only pivot about main body 11 and integral extension 28 until inner back surface 50 comes in contact with a portion of extension 28. As can be seen in FIG. 2, the opposing lips 32*a*, 32*b* of the cantilever projection 30 automatically grip and hold the door window frame 26 in a space relation from the vehicle frame 22. The door stabilizer clip 10 of the preferred embodiment holds the door frame 26 approximately ½ inch away from the vehicle frame 22. Although the door stabilizer clip 10 is shown in FIGS. 1 and 2 to be releasably secured to a welding flange 20 of the vehicle side frame 22, wherein the welding flange 20 is held in cavity 18, clip 10 can also be secured to a welding flange of the vehicle roof frame.

Figure 3:
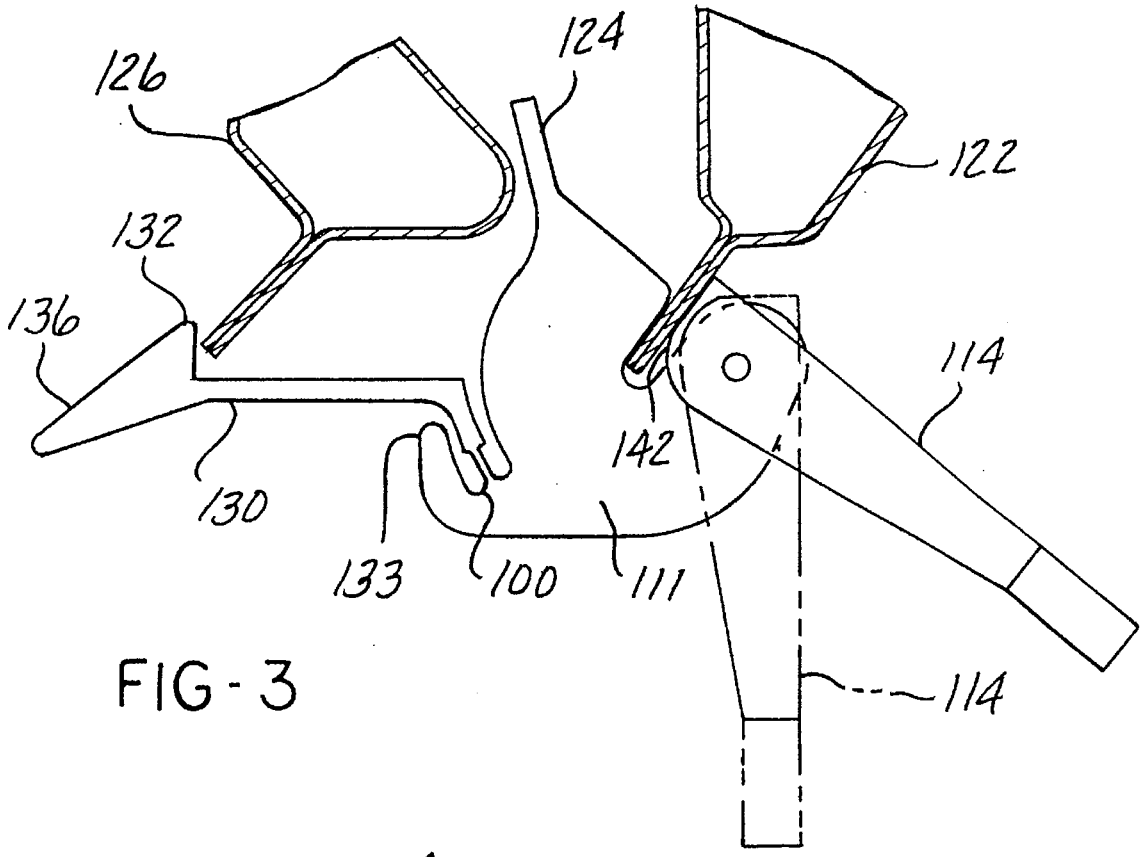
FIG. 3 is a second embodiment of a door stabilizer clip connected to a welding flange of a vehicle side frame and a door window frame.
Figure 4:
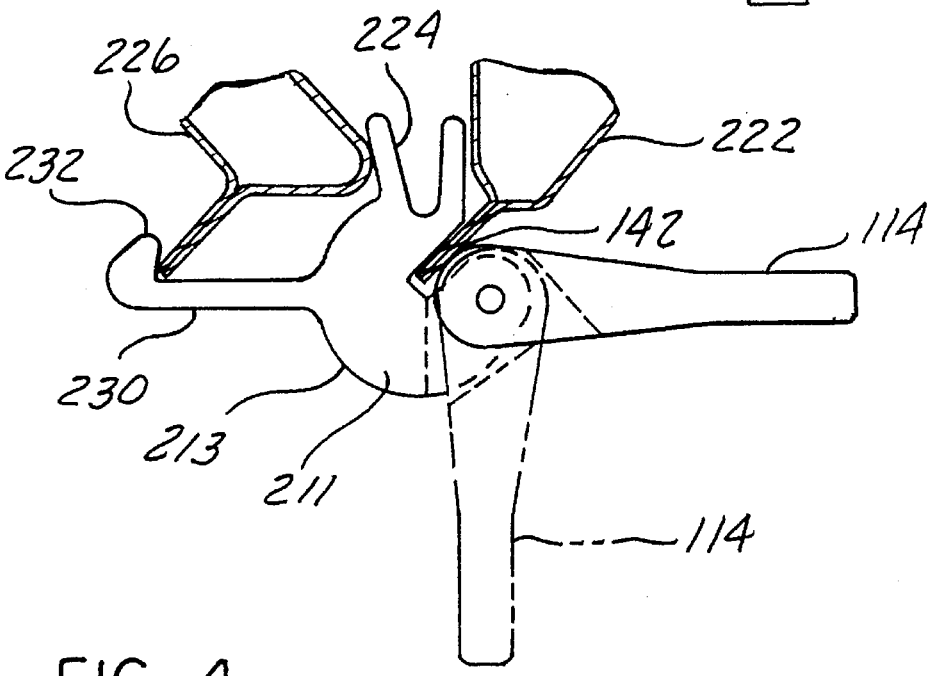
FIG. 4 is another embodiment of a door stabilizer clip in use on a welding flange of a vehicle side frame and a door window frame.

FIGS. 3 and 4 show alternate embodiments of the door stabilizer clip 10. In FIG. 3, the opposing lips on the cantilever projection are replaced by a hook 132 that angularly holds the door window frame 126 in place. The hook 132 can be dislodged from the door window frame 126 by the thumb depress 136 pushed in a downward direction. The thumb depress 136 will cause the cantilever projection 130 to flex about the flex point indicated at 100. FIG. 3 also shows a hook arm 133 located below the cantilever projection 130. The purpose of the hook arm 133 is to provide a limiter to the pivotal movement of the locking lever 114 about main body 111. FIG. 3 also includes an extending spacer/stop 124 that extends from the upper portion of the C-shaped body 111. The spacer/stop 124 in connection with the hook 132 maintains the window frame 126 within the defined area between the hook 132 and spacer/stop 124. This prevents the door window frame 126 from coming into contact with the door roof frame 122. This extended spacer/stop 124 is not required in the preferred embodiment (FIGS. 1 and 2) because the opposing lips 32*a*, 32*b* in the cantilever projection 30 of the preferred embodiment firmly grip and hold the door window frame 26 securely enough to maintain its position at a distance from the vehicle roof or side frame 22.

FIG. 4 provides yet another embodiment wherein the thumb depress has been eliminated. Just as in FIG. 3, a hook 232 is provided to hold the door window frame 226 in place and the spacer/stop is replaced by a U-shaped spacer 224 that maintains the distance between the door window frame 226 and the vehicle roof frame 222. In the embodiment of FIG. 4, the cantilever projection 230 does not partially encircle the C-shaped main body 211, but instead, extends laterally from an outer surface 213 of the main body 211. The hook 232 can be pressed down to release hook 232 from the door window frame 226. In both FIGS. 3 and 4, the locking lever 114 and cam surfaces 142 work in similar fashion as in the preferred embodiment.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A door stabilizer clip for use to hold a vehicle door in a spaced relationship from the vehicle frame comprising:

a clamp body;

a locking lever pivotally connected to said clamp body;

said clamp body having a first restraining means for engaging a portion of the vehicle frame at a predetermined position; and a second restraining means for holding the vehicle door at a second predetermined position, and a spacer disposed between the first and second restraining means, wherein said locking lever pivots about the clamp body to selectively lock and release engagement of the clamp body from the vehicle frame; and at least one of said restraining means is formed in one piece with the clamp body.

2. The door stabilizer clip of claim 1, wherein the clamp body has a C-shaped configuration and an integral extension encircling a portion of an exterior of the C-shaped configuration and extends beyond the C-shaped configuration to form a cantilever portion.

3. The door stabilizer clip of claim 2 wherein the C-shaped configuration of the clamp body forms a cavity to define the first restraining means, and said cavity is disposed between a pair of legs forming the C-shaped configuration.

4. The door stabilizer clip of claim 2, wherein the second restraining means is located in the cantilever portion.

5. The door stabilizer clip of claim 3, wherein the locking lever is pivotally connected to the clamp body in a first leg of the C-shaped configuration.

6. The door stabilizer of claim 4 wherein a second leg of the C-shaped configuration defines the spacer.

7. The door stabilizer clip of claim 4, wherein a distal end of said cantilever portion forms a thumb depress for selectively securing and releasing said second restraining means to and from the vehicle door.

8. The door stabilizer clip of claim 6, wherein the second restraining means is a hook.

9. The door stabilizer clip of claim 7, wherein the second restraining means are two opposing lips forming a channel therebetween, said channel formed for securing a portion of the vehicle door.

* * * * *